US009174833B2

(12) United States Patent
Yang et al.

(10) Patent No.: US 9,174,833 B2
(45) Date of Patent: Nov. 3, 2015

(54) FRONT ROOM BEVERAGE DISPENSE APPARATUS

(71) Applicant: CORNELIUS, INC., St. Paul, MN (US)

(72) Inventors: Xiaofeng Yang, Tianjin (CN); Klaus Wiemer, Muehlheim (DE); Sreekanth Pushpala, Bangalore (IN); Nishant Kulkarni, Bangalore (IN)

(73) Assignee: Cornelius, Inc., St. Paul, MN (US)

( * ) Notice: Subject to any disclaimer, the term of this patent is extended or adjusted under 35 U.S.C. 154(b) by 15 days.

(21) Appl. No.: 14/152,798

(22) Filed: Jan. 10, 2014

(65) Prior Publication Data

US 2014/0190991 A1 Jul. 10, 2014

Related U.S. Application Data

(60) Provisional application No. 61/750,901, filed on Jan. 10, 2013.

(51) Int. Cl.

| | |
|---|---|
| ***B67D 7/74*** | (2010.01) |
| ***B67D 1/08*** | (2006.01) |
| ***B67D 1/00*** | (2006.01) |

(52) U.S. Cl.

CPC ..... *B67D 1/0862* (2013.01); *B67D 1/0004* (2013.01)

(58) Field of Classification Search

CPC .. B67D 1/0862; B67D 1/0857; B67D 1/0895; B67D 1/0004

USPC ..... 222/105, 106, 146.1–146.6, 222/129.1–129.4

See application file for complete search history.

(56) References Cited

U.S. PATENT DOCUMENTS

| | | | | |
|---|---|---|---|---|
| 127,958 | A * | 6/1872 | Cohen | 62/338 |
| 4,555,045 | A * | 11/1985 | Rodth et al. | 222/1 |
| 4,688,701 | A | 8/1987 | Sedam | |
| 5,080,261 | A * | 1/1992 | Green | 222/129.1 |
| 5,803,312 | A * | 9/1998 | Credle et al. | 222/129.1 |
| 6,010,043 | A * | 1/2000 | Williamson et al. | 222/608 |
| 6,669,053 | B1 * | 12/2003 | Garson et al. | 222/61 |
| 8,499,978 | B2 * | 8/2013 | Dalchau et al. | 222/146.1 |
| 8,708,197 | B1 * | 4/2014 | Brewer | 222/146.6 |
| 2003/0066306 | A1 | 4/2003 | Renken et al. | |
| 2008/0083780 | A1 * | 4/2008 | Romanyszyn et al. | 222/129.1 |
| 2008/0277417 | A1 | 11/2008 | Groesbeck | |
| 2012/0042682 | A1 | 2/2012 | Cominski | |

FOREIGN PATENT DOCUMENTS

| | | | | |
|---|---|---|---|---|
| WO | WO-2012/178044 | A1 * | 12/2012 | 222/129.1 |

OTHER PUBLICATIONS

International Search Report and Written Opinion, PCT/US2014/01131, date of mailing May 6, 2014.

* cited by examiner

*Primary Examiner* — Lien Ngo

(74) *Attorney, Agent, or Firm* — Andrus Intellectual Property Law, LLP

(57) ABSTRACT

The invention relates to a beverage dispense apparatus that maintains syrup containers in a housing, thereby eliminating plumbing required by prior art Bag-in-Box dispensers.

17 Claims, 4 Drawing Sheets

FRONT ROOM BEVERAGE DISPENSE APPARATUS

PRIORITY CLAIM

THIS APPLICATION CLAIMS PRIORITY TO U.S PROVISIONAL PATENT APPLICATION No. 61/750,901, ENTITLED "FRONT ROOM BEVERAGE DISPENSE APPARATUS," FILED JAN. 10, 2013, THE DISCLOSURE OF WHICH IS HEREBY INCORPORATED HEREIN BY REFERENCE IN ITS ENTIRETY.

FIELD OF THE INVENTION

The present invention relates to a beverage dispensing apparatus, and more particularly, to a beverage dispenser that houses the syrup, water, pumps and cooling unit in a single housing.

DESCRIPTION OF THE PRIOR ART

Prior art beverage dispensers using Bag-in-Box syrups have a front room dispenser and a back room component. The syrups for beverages are located in the back room, and are connected to the dispenser in the front room via beverage lines.

The beverage lines are cumbersome because they require the installation of beverage lines from the front room to the back room. Moreover, the beverage lines may be difficult to clean, and are not cooled, therefore causing syrup to warm to room temperature.

It would be extremely advantageous to have a beverage dispensing device that does not require a back room installation, and that does not allow syrup to warm to room temperature.

SUMMARY OF THE INVENTION

One embodiment of the storage and beverage dispense apparatus of the present invention includes a housing containing pumps (for example, for pressurizing water and syrup), a cooling and refrigeration system, and a syrup storage (commonly referred to as a Bag-in-Box or BIB system) in a single housing unit. The housing can be integral, or it may consist of modular components.

Further the storage and beverage dispense apparatus of the present invention includes packaging these components in a housing, the need for a back room package is eliminated, thereby saving space and reducing the cost of plumbing. Moreover, the proximity of the pumps to the valves eliminates the pressure drop that can occur in long fluid lines.

Another embodiment of the present invention utilizes a modular system where refrigeration, a pumping system (or a different type of product delivery system) and a BIB/syrup dispense system are connected. The dispense system may consist of a tower with one or more dispense valves. The system's modules may be packaged so that they fit in an under-the-counter system.

In the present invention, the dispense valves may consist of a flexible design for converting between carbonated beverage and non-carbonated beverage dispense. Moreover, the dispense valves may also convert between a cold beverage system and a hot beverage system using an optional kit.

A still further embodiment of the invention, the apparatus includes a dispenser that uses in-line or cold carbonated technologies for providing the carbonated beverage. The carbonation system may be an in-line system, or an external system.

The system of the present invention also includes methods for cooling the syrups placed in an ambient condition, before dispensing it through the dispense valve. The cooling methods are applicable for an integrated or modular beverage dispensing system. Examples of cooling methods include an indirect cooling system where refrigerant or a cold secondary medium, such as water, water mixed with glycol, or a brine solution is passed through a cold plate with embedded cooling coils. The syrup containers/BIB are directly placed on top or on the sides of the cold plate(s).

Another exemplary cooling method of the present invention utilizes an indirect cooling system where a cold secondary medium such as water, water mixed with glycol, or a brine solution is passed through the cooling coils embedded in the cabinet holding the syrup containers. The cooling plate could also be chilled using a direct refrigeration system.

DETAILED DESCRIPTION OF THE PREFERRED EMBODIMENT

Figure 1:
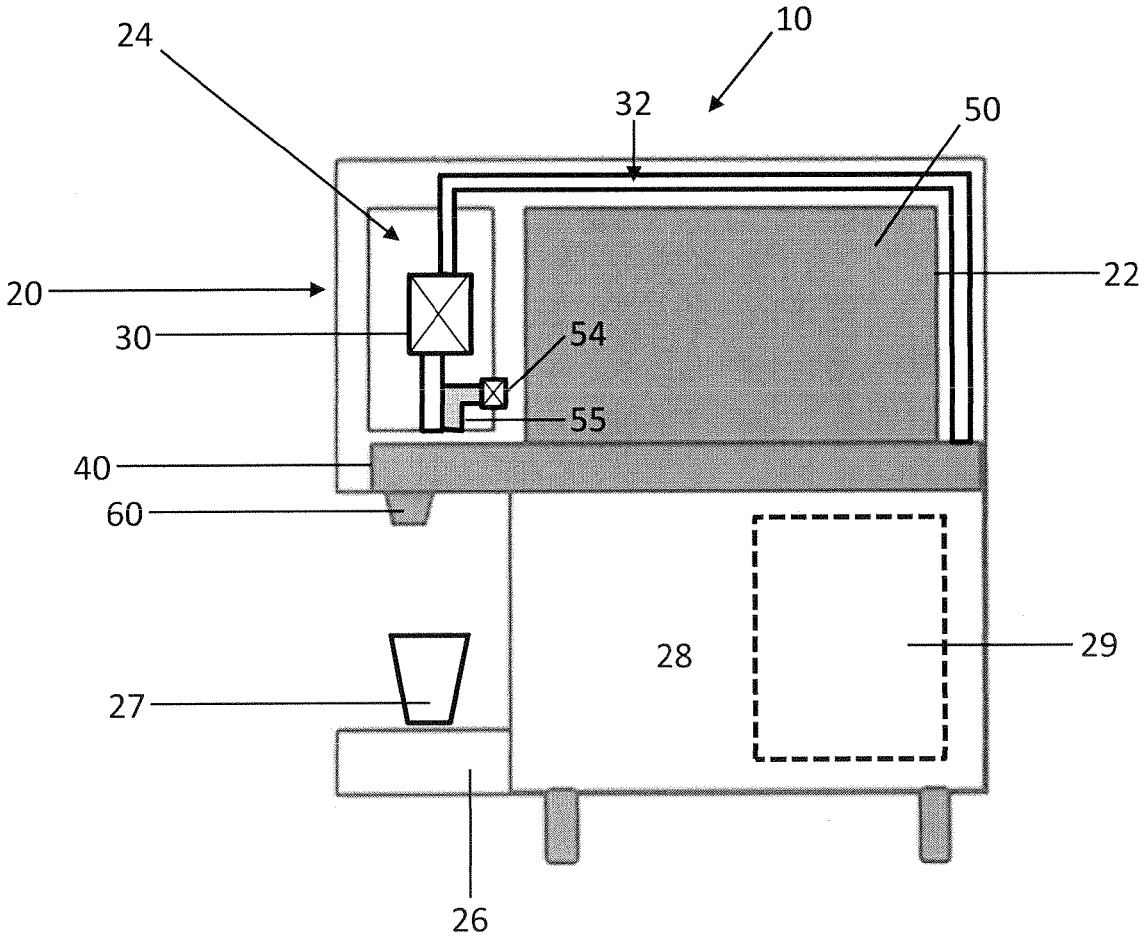
FIG. 1 is a side view of an embodiment in which the product delivery system, the syrup containers (or Bag-in-Box), cooling system and dispenser are contained in a single housing.
Figure 1A:
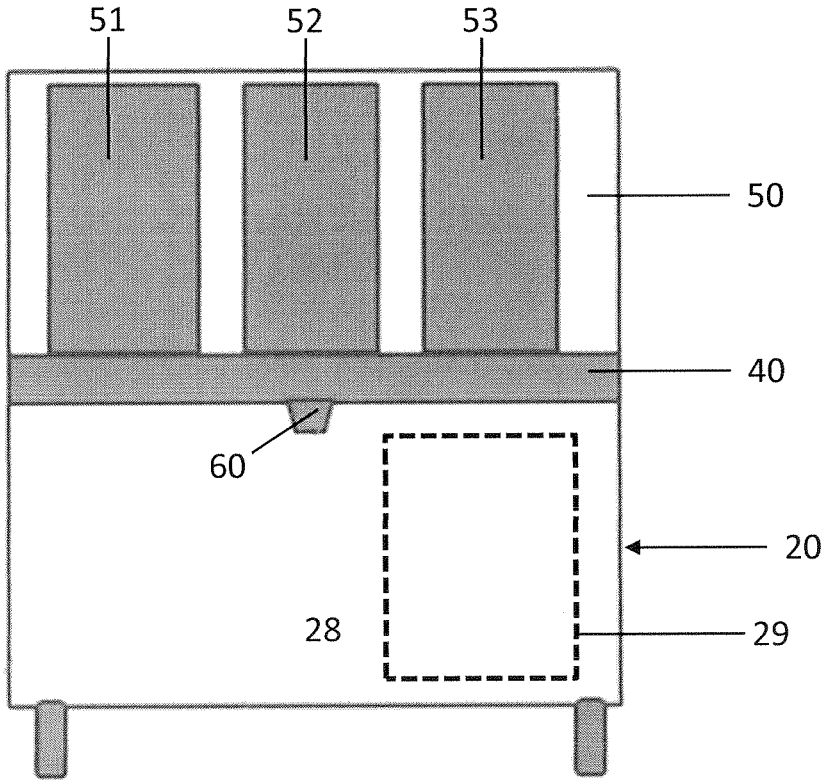
FIG. 1A is a front view of the system disclosed in FIG. 1.

Referring to the drawings and more particularly to the embodiments of FIGS. 1 and 1A, the beverage dispensing apparatus 10 includes a housing 20. The housing 20 includes several components but may take the form of a traditional beverage dispensing system well-known in the art. The housing 20 further includes an insulated portion 22 and a non-insulated portion 24. The housing 20 also includes a drink cup platform 26 which may accommodate a drink cup 27. The housing 20 also includes a refrigeration system 28 which may include a compressor, evaporator and water bath (not shown). Alternatively, the refrigeration system 28 could include an ice making system (not shown) that creates ice which could be stored within an ice storage bin 29 in a compartment within the refrigeration system 28. The non-insulated portion 24 of the housing 20 is adapted to accommodate a water pump 30 which pumps water through a water delivery system 32. The water delivery system 32 could provide either carbonated water or non-carbonated water.

The housing 20 further accommodates a cold plate 40. The cold plate 40 typically maintains a temperature sufficient to chill the water or carbonated water in the water delivery system 32. It is preferred that water flowing through the water delivery system 32 is chilled by the cold plate 40. The temperature of the cold plate 40 may be maintained by the refrigeration system 28. Alternatively, the temperature of the cold plate 40 may be maintained through contact with the ice storage bin 29. Examples of cooling methods include an indirect cooling system where the refrigerant from the refrigeration system 28 or a cold secondary medium from the ice storage bin 29, such as water, water mixed with glycol, or a brine solution may be passed through a cold plate 40 with embedded cooling coils.

The housing 20 also contains a syrup storage compartment 50. In the apparatus 10 shown, the syrup storage compartment 50 that may accommodate three syrup containers 51, 52, and 53. The syrup containers of the preferred embodiment are typically a bag-in-box syrup storage container (BIB). The BIB system is well-known in the industry and typically includes syrup at a 5 to 1 mixing ratio. The syrup can be combined in a dispense nozzle to reconstruct a desired beverage. The various syrup containers 51, 52, and 53 are added to deliver syrup via delivery tube 55 and pump 54 to the nozzle 60. Each syrup storage container 51, 52, and 53 would include a pump 54 and delivery tube 55. The syrup storage containers 51, 52, and 53 may be positioned directly on top or on the sides of the cold plate 40.

The housing 20 also includes a nozzle 60. The water delivery system 32 and syrup delivery tube 55 deliver water and syrup to the nozzle 60. Typically, the ratio of water to syrup delivered to the nozzle 60 is 5 parts water to 1 part syrup. However, other ratios may be used within the apparatus 10. The syrup storage compartment 50 is positioned above the cold plate 40. The syrup storage compartment 50 and the syrup storage containers 51, 52, and 53 are placed in contact with the cold plate 40 such that the syrup may be chilled from ambient temperature of the room to a temperature necessary for storing the syrup. Typically, in prior embodiments of beverage dispense apparatuses, BIBs are located in a separate room away from the beverage dispense system. Placing the syrup storage containers 51, 52 and 53 in a separate room requires additional plumbing for the delivery tube 55 disclosed in the present invention. In other words, beverage lines must be installed to connect the dispense nozzle 60, which is in the front room, to the BIB in the back room.

Having the syrup storage compartment 50 in close proximity to the delivery nozzle 60 and contained within the housing 20 eliminates the need for a backroom storage package, thus, saving space and reducing plumbing costs. Moreover, the proximity of the pumps to the delivery valves in the nozzle 60 eliminates the pressure drop that occurs in lengthy fluid delivery tubes 55. A further advantage of the invention is that the syrup can be cooled on the cold plate 40.

The beverage dispensing apparatus 10 of the present invention includes a housing 20, a product delivery system 30, a nozzle 60, a cold plate 40, and a syrup storage compartment 50.

Figure 2:
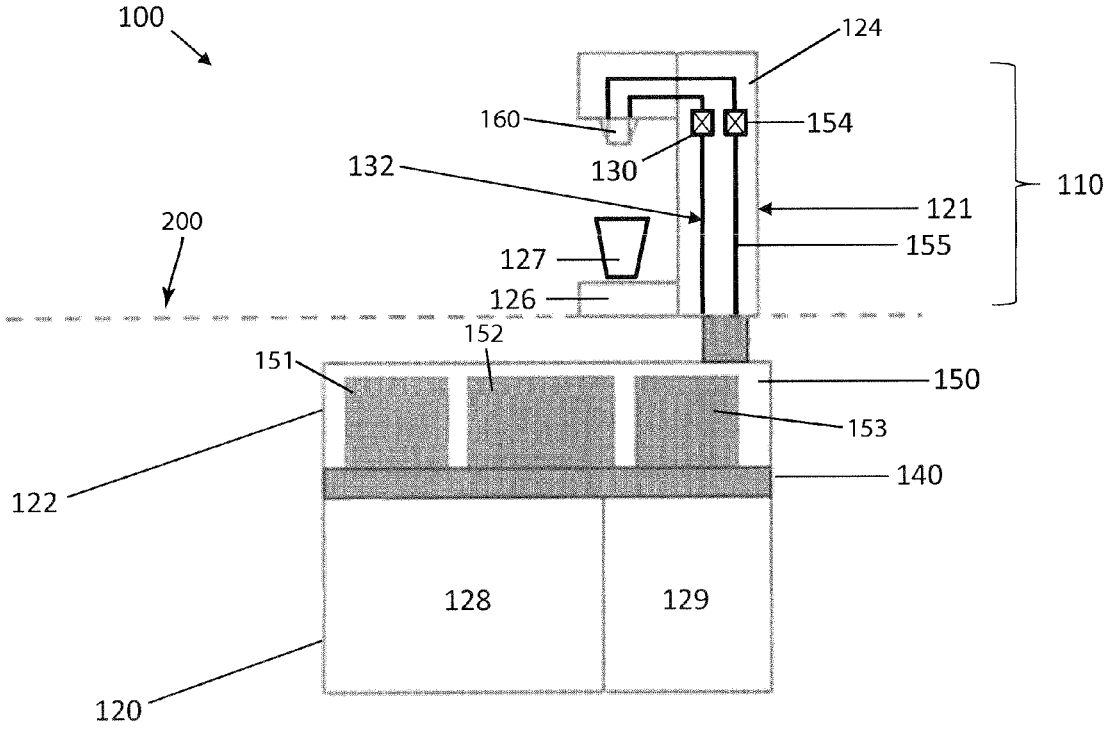
FIG. 2 is a side view of a second embodiment in which the cooling unit, syrup containers and pumps are positioned below the dispenser.
Figure 3:
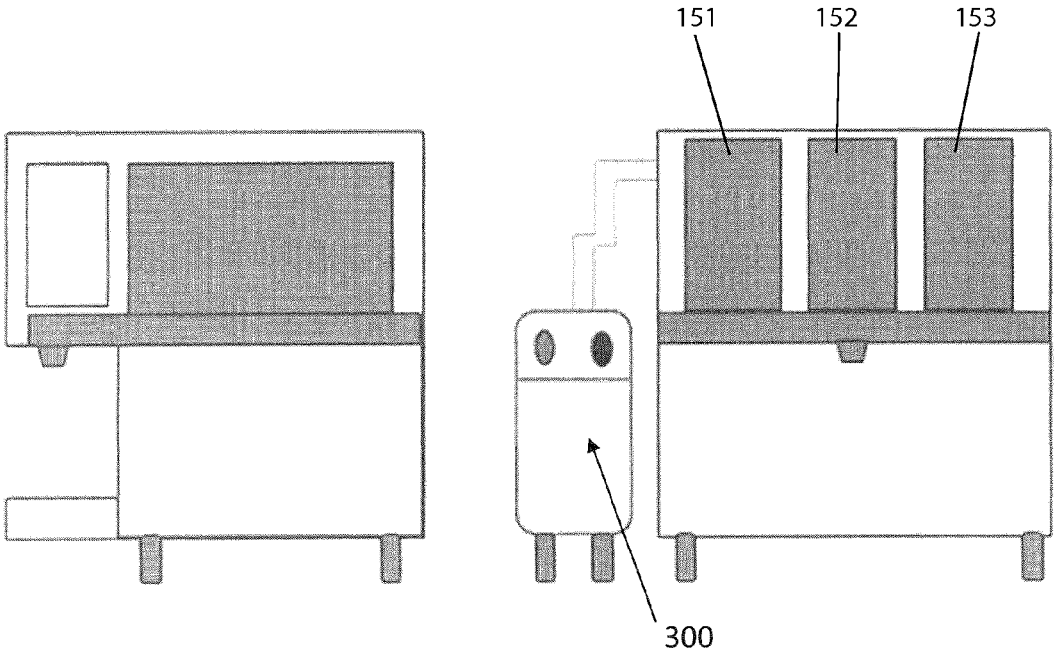
FIG. 3 is the embodiment of FIG. 1 with the addition of a hot kit dispenser connection.

Referring to a second embodiment in FIG. 2, the configuration essentially includes all of the components of the embodiment of FIGS. 1 and 1A, with the exception that the components are arranged in a different configuration. The beverage dispense apparatus 100 includes a housing 120 positioned below a counter 200 in which the beverage dispense apparatus is installed. The beverage delivery system 110 is positioned above the counter 200.

The housing 120 includes a beverage storage compartment 150, a cold plate 140, and a refrigeration system 128. The housing 20 includes an insulated portion 122 and a non-insulated compartment 124. The housing 120 also includes a drink cup platform 126 which may accommodate a drink cup 127. The housing 120 also includes a refrigeration system 128 which may include a compressor, evaporator and water bath (not shown). Alternatively, the refrigeration system 128 could include an ice making system (not shown) that creates ice which could be stored within an ice storage bin 129 in a compartment within the refrigeration system 128. The non-insulated portion 124 of the housing 120 is adapted to accommodate a water pump 130 which pumps water through a water delivery system 132. The water delivery system 132 could provide either carbonated or non-carbonated water.

The housing 120 further accommodates a cold plate 140. The cold plate 140 is typically maintained at a temperature sufficient to chill the water or carbonated water in the water delivery system (e.g. water supply tube 132). It is preferred that water flowing through the water delivery system is chilled by the cold plate 140. The temperature of the cold plate 140 may be maintained by the refrigeration system 128. Alternatively, the temperature of the cold plate 140 may be maintained through contact with the ice storage bin 129. Examples of cooling methods include an indirect cooling system where the refrigerant from the refrigeration system 128 or a cold secondary medium from the ice storage bin 129, such as water, water mixed with glycol, or a brine solution may be passed through a cold plate 140 with embedded cooling coils.

The housing 120 also contains a syrup storage compartment 150. In the beverage delivery system 110 shown, the syrup storage compartment 150 that may accommodate three syrup containers 151, 152 and 153. The syrup containers of the preferred embodiment are typically a bag-in-box syrup storage container (BIB). The BIB system is well-known in the industry and typically includes syrup at a 5 to 1 mixing ratio. The various syrup containers 151, 152 and 153 are added to deliver syrup via delivery tube 155 and pump 154 to nozzle 160. Each syrup storage container 151, 152 and 153 would include a pump 154 and delivery tube 155. The syrup storage containers 151, 152 and 153 may be positioned directly on top or on the sides of the cold plate 140.

The beverage delivery system 110 houses a water supply tube 132 and one or more delivery tubes 155. The beverage delivery system 110 may also include a water pump 130 connected to the water supply tube 132. The beverage delivery system 110 may also include a syrup delivery pump 154 connected to the syrup delivery tube 155. The beverage delivery system 110 also includes a nozzle 160 wherein the water supplied by the water supply tube 132 is mixed with the syrup delivery tube 155.

The water supply tube 132 may optionally pass through a hot kit 300 for delivering a warm beverage to a user. A beverage line passing through the hot kit 300 preferably does not come in contact with the cold plate 140.

Typically the ratio of water to syrup delivered to the nozzle 160 is 5 parts water to 1 part syrup; however, other ratios may be used. The syrup storage compartment 150 is positioned above the cold plate 140. The syrup storage compartment 150 and the syrup storage containers 151, 152, and 153 are placed in contact with the cold plate 140 such that the syrup may be chilled from ambient temperature of the room to a temperature necessary for storing the syrup. Typically, in prior embodiments of beverage dispense apparatuses or BIBs are located in a separate room away from the product delivery system. Placing the syrup storage containers 151, 152 and 153 in a separate room requires additional plumbing for the delivery tube 155 disclosed in the present invention. Having the syrup storage compartment 150 in close proximity to the delivery nozzle 160 and contained within the housing 120 eliminates the need for a backroom storage package, thus, saving space and reducing plumbing costs. Moreover, the proximity of the pumps 154 to the delivery valves in the nozzle 160 eliminates the pressure drop that occurs in lengthy fluid delivery tubes 155.

What is claimed is:

1. A beverage dispensing apparatus comprising:

a housing;

a dispensing nozzle on the housing;

a cold plate disposed in the housing;

a syrup container disposed in the housing and containing, a syrup; and a beverage delivery system disposed in the housing and configured to deliver a beverage mixture containing the syrup to the dispensing nozzle;

wherein the syrup container is cooled by the cold plate.

2. The beverage dispensing apparatus according to claim 1, wherein the syrup container is in contact with the cold plate such that the cold plate directly cools the syrup.

3. The beverage dispensing apparatus according to claim 1, wherein the housing comprises an insulated portion and a non-insulated portion and wherein the syrup container is disposed in the insulated portion.

4. The beverage dispensing apparatus according to claim 3, wherein the cold plate is positioned adjacent to the insulated portion.

5. The beverage dispensing apparatus according to claim 1, further comprising a refrigeration system disposed in the housing, wherein the cold plate is indirectly cooled by the refrigeration system.

6. The beverage dispensing, apparatus according to claim 1, further comprising a refrigeration system disposed in the housing, wherein the cold plate is directly cooled by the refrigeration system.

7. The beverage dispensing apparatus according to claim 6, wherein the refrigeration system directly cools the housing by supplying a refrigerant to the cold plate.

8. The beverage dispensing apparatus according to claim 6, wherein the refrigeration system directly cools the housing by supplying a cold secondary medium to the cold plate.

9. The beverage dispensing apparatus according to claim 1, wherein the beverage mixture also contains water and wherein the beverage delivery system comprises a water delivery system that pumps water to the dispensing nozzle.

10. The beverage dispensing apparatus according to claim 9, wherein the water is cooled by the cold plate.

11. The beverage dispensing apparatus according to claim 10, wherein the beverage delivery system further comprises a syrup delivery system that pumps the syrup to the dispensing nozzle.

12. The beverage dispensing apparatus according to claim 1, wherein the syrup container comprises a bag-in-box syrup container.

13. The beverage dispensing apparatus according to claim 1, wherein the syrup container is disposed directly on top of the cold plate.

14. The beverage dispenser according to claim 1, wherein the beverage mixture comprises carbonated water and the syrup.

15. The beverage dispenser according to claim 1, wherein the beverage mixture comprises non-carbonated water and the syrup.

16. The beverage dispensing apparatus according to claim 1, further comprising a drink cup platform on the housing, wherein the drink cup platform is configured to support a drink' cup that receives the beverage mixture from the dispensing nozzle.

17. A beverage dispensing apparatus comprising:

a housing;

a dispensing nozzle on the housing;

a cold plate disposed in the housing;

a bag-in-box syrup container disposed in the housing and containing a syrup;

a beverage delivery system disposed in the housing and configured to deliver a beverage mixture containing water and the syrup to the dispensing, nozzle, wherein the water is cooled by the cold plate; and a refrigeration system disposed in the housing and supplying a refrigerant or cold secondary medium to the cold plate; and wherein the syrup container is in contact with the cold plate such that the cold plate cools syrup in the syrup container.

* * * * *